US005428969A

United States Patent [19]

Day et al.

[11] Patent Number: 5,428,969

[45] Date of Patent: Jul. 4, 1995

[54] UPHOLSTERY FABRIC INCORPORATING CHENILLE YARN ON ONE FACE

[75] Inventors: Gerald F. Day, Derbyshire; Tony M. Lay, Narborough; Gary J. Leeke, Leicester, all of United Kingdom

[73] Assignee: General Motors Corporation, Detroit, Mich.

[21] Appl. No.: 222,483

[22] Filed: Mar. 28, 1994

[30] Foreign Application Priority Data

Apr. 8, 1993 [GB] United Kingdom ..... 9307381

[51] Int. Cl.[6] ..... D04B 1/14; D04B 1/02

[52] U.S. Cl. ..... 66/202; 28/144

[58] Field of Search ..... 66/8, 19, 194, 202, 66/196, 197, 198, 170, 171, 60 R, 64; 28/144

[56] References Cited

U.S. PATENT DOCUMENTS

| | | | |
|---|---|---|---|
| Re. 30,638 | 6/1981 | Bryars | 66/191 |
| 2,276,124 | 3/1942 | Unger | 28/144 |
| 2,416,758 | 3/1947 | Knowles | 66/202 |
| 2,519,493 | 8/1950 | Nakayama | 66/202 X |
| 2,741,108 | 4/1956 | Rogosin | 66/202 X |
| 2,741,825 | 4/1956 | Runton et al. | 66/202 X |
| 2,948,133 | 8/1960 | Schwartz | 66/202 X |
| 3,494,150 | 2/1970 | Grau | 66/86 |
| 3,760,611 | 9/1973 | Duckworth | 66/177 |
| 3,952,555 | 4/1976 | Lesley | 66/195 |
| 4,007,611 | 2/1977 | Blezard | 66/195 |
| 4,019,350 | 4/1977 | Schmidt | 66/19 X |
| 4,079,602 | 3/1978 | Blore | 66/196 |
| 4,244,197 | 1/1981 | Althammer | 66/19 |
| 4,244,198 | 1/1981 | Schaab et al. | 66/191 |
| 4,517,715 | 5/1985 | Yoshida et al. | 28/144 |
| 4,712,281 | 12/1987 | Scheller | 28/162 |
| 4,733,546 | 3/1988 | Toda | 66/202 |
| 4,794,767 | 1/1989 | Lombardi | 66/190 |
| 5,009,946 | 4/1991 | Hatomoto et al. | 428/87 |

FOREIGN PATENT DOCUMENTS

| | | |
|---|---|---|
| 0091676 | 10/1983 | European Pat. Off. . |
| 2512082 | of 1982 | France . |
| 58-169542 | 10/1983 | Japan . |
| 59-021783 | 2/1984 | Japan . |
| 60-045637 | 3/1985 | Japan . |
| 564391 | 2/1943 | United Kingdom . |
| 568233 | 3/1943 | United Kingdom . |
| 1226549 | 5/1968 | United Kingdom . |
| 1237131 | 9/1968 | United Kingdom . |
| 1293849 | 10/1972 | United Kingdom . |
| 1427619 | 3/1976 | United Kingdom . |
| 1603040 | 4/1978 | United Kingdom . |

OTHER PUBLICATIONS

"Advanced Knitting Principles", Charles Reichman, published by National Knitted Outerwear Assn (PP4–9).

"Knitting Times", Apr. 18, 1983, pp. 79–83.

"WST Knitting Technic", vol. 4 (1982), No. 4, pp. 257–259 & same article in German from Wirkerei & Strickerei Technik, vol. 32 (1982), pp. 128–131.

International Textile Bulletin, 4th Quarter 1982, pp. 143–149.

*Primary Examiner*—John J. Calvert

*Attorney, Agent, or Firm*—Davis Hoxie Faithfull & Hapgood

[57] ABSTRACT

A weft knitted upholstery fabric having an aesthetic surface and incorporating a ground yarn (preferably with a count between 550 and 900 decitex) and a chenille yarn (preferably having a decitex in the range 2000 to 5000), the chenille yarn being knitted into the fabric as full loop stitches to leave the chenille yarn evident on the aesthetic surface of the fabric.

15 Claims, 4 Drawing Sheets

UPHOLSTERY FABRIC INCORPORATING CHENILLE YARN ON ONE FACE

BACKGROUND OF THE INVENTION

1. Field of the Invention

This invention relates to an upholstery fabric and to a method of manufacturing an upholstery fabric, and has particular reference to a fabric having a soft touch or velour type feel.

2. Description of the Related Art

Woven velour fabrics are well known for upholstering purposes, particularly for upholstery in motor vehicles such as cars. Such velour fabrics have an attractive feel and are regarded as a high quality fabric for use in car upholstery. A velour fabric is characterised by the fact that it has a very short pile and has a comparatively soft touch compared to a conventional woven fabric. The softness of the touch is associated with a rocking action of the pile when the velour is stroked or the fingers of a hand are rocked backwards and forwards on the velour.

Velour fabrics were initially produced by forming a complex weave from two warps which were interconnected by transverse fibres. On cutting the transverse fibres to separate the two warps, the remains of the interconnecting fibres form a short pile which gives the velour its characteristic feel.

More recently, such velour fabrics have been produced with a nylon or polyester pile by the use of a twin needle bar Raschel warp knitting machine, again to produce two interconnected layers of fabric which are sliced apart to produce two separate velour fabric pieces.

With a woven or warp-knitted velour fabric, a seat is upholstered in a conventional manner by the so-called cut-and-sew route. Individual panels of the fabric are cut to shape out of a piece of fabric and then the panels are sewn together to produce an upholstery cover. This is positioned over an upholstery core—typically a foam bun or other suitable core—to produce the seat.

More recently, proposals have been made to produce a three-dimensional knitted structure whereby a knitted upholstery fabric can be produced in a shaped form so that the knitted structure can be used immediately to upholster a core without need for expensive cutting and sewing operations. Such three-dimensional knitting of fabric structures for upholstery is described, for example, in EP-A-0518582, GB-A-2223034, GB-A-2223035 and GB-A-2223036, the contents of all of which specifications are incorporated herein by way of reference. Essentially, all such prior references utilise a flat V-bed weft knitting machine having a pair of opposed needle beds, the needles of which may be actuated by a plurality of cams, in a preferred arrangement under the control of a computerised cam actuating and needle selection mechanism.

To date, however, all the fabrics which have been produced in accordance with such three-dimensionally knitted structure systems have had a hard wearing external surface. Although the surface may be formed of a plurality of different coloured threads, so as to give an attractive pattern or other appearance on the surface, the feel of the surface of a prior art three dimensional knitted fabric has always been relatively hard.

The present invention is concerned with a knitted upholstery fabric, but one having a velour-like soft touch aesthetic surface. By "aesthetic surface" as used herein is meant a surface which, in use, is on the visible exterior of an upholstered structure or is so positioned as to be in visible or tactile relationship with a consumer or user of such a surface.

A single jersey fabric, namely a fabric which can be produced on a single row of needles, has a technical face side, which is produced in contact with the needle bed, and a technical reverse side which is away from the needle bed. Where such a fabric is produced on a V-bed machine the technical reverse side of the fabric is the side of the fabric nearer the centre line of the V-bed. In conventional knitted garment production, the technical face of the fabric is the face seen by the user and is normally the face on the exterior of the garment.

A double jersey structure, by comparison, is produced on both beds of a V-bed knitting machine, and has in effect a pair of faces interconnected by interengaging loops of knitting. It will be appreciated, therefore, that double jersey structures tend to be heavier in weight than single jersey structures.

The application of the present invention permits the production of both knitted single jersey fabrics having a velour-like feel as well as knitted double jersey fabrics having a velour-like feel. A further advantage of the invention is that, in its preferred form, it maximises the use of comparatively expensive "effect" yarns, namely relatively expensive chenille yarns.

By "chenille yarn" as is used herein is meant a yarn having a elongate core extending continuously in the direction of the yarn and a pile extending substantially at right-angles to the core so as to give the chenille yarn its characteristic appearance and properties.

SUMMARY OF THE INVENTION

By the present invention there is provided a single jersey weft knitted fabric suitable for use as an upholstery fabric being formed of at least two yarns, a chenille yarn and a ground yarn, the chenille yarn being knitted into the fabric as full loop stitches. Desirably the chenille yarn has a decitex in the range 2000 to 5000 and the ground yarn has a decitex in the range 550 to 900, conveniently there being in the range 8 to 16 wales per inch (2.54 cm) in a course-wise direction, and in the range 8 to 30 courses per inch in the wale-wise direction, the chenille yarn being knitted into the fabric as knitted looped stitches, with the aesthetic surface of the fabric on which the chenille yarn is evident being the technical reverse side of the fabric. Preferably no chenille yarn stitch has more than six adjacent chenille stitches in a wale-wise direction.

The ground yarn is preferably an air-textured polyester yarn having a decitex in the region 550 to 900 or 600 to 800 or 600 to 750 or 650 to 700 decitex. The chenille yarn may be formed of a pair of twisted nylon and/or polyester strands trapping therebetween a pile. The pile may be bonded to the strands for example by the use of a low-melting point nylon strand, or the pile may be moveable relative to the strands.

The chenille yarn may have a count in the range 2500 to 5000 decitex, preferably 3000 to 4000, further preferably 3250 to 3500, or 3350. The chenille yarn is preferably one having moveable pile and/or an extensible core.

Preferably each full loop chenille yarn stitch has a ground yarn stitch on either side and has a ground yarn stitch on each adjacent course. Preferably no region of the fabric has more than six adjacent full loop chenille yarn stitches in a course-wise direction.

The present invention further provides a single jersey weft knitted fabric formed of at least two yarns, a chenille yarn and a ground yarn, the chenille yarn having a decitex in the range 2000 to 5000 and the ground yarn having a decitex in the range 550 to 900, there being in the range 8 to 16 wales per inch in a course-wise direction of the fabric, and in the range 8 to 30 courses per inch in a wale-wise direction, the chenille yarn being knitted into the fabric as knitted looped stitches, with the aesthetic surface of the fabric on which the chenille yarn is evident being the technical reverse side of the fabric.

The chenille yarn may have a decitex in the range 2000 to 5000. The ground yarn is preferably an air-textured polyester yarn having a decitex in the range 550 to 900.

The present invention yet further provides a weft knitted double jersey upholstery fabric which is characterised in that the fabric is knitted from at least two yarns, one of which is a chenille yarn, in that the chenille yarn is knitted into the fabric as looped stitches so as to be apparent on one side only of the fabric in any predetermined region of the fabric, in that the yarn count of the chenille yarn is greater than that of the other yarn and in that a greater number of stitches of the other yarn is provided on the non-chenille side so as to balance the fabric and produce a substantially non-curling fabric.

The present invention further provides such a double jersey fabric in which the chenille yarn has a count in the range 1000 to 2500 decitex, the other yarn has a count in the range 500 to 800 decitex, and the fabric has been knitted on a machine having a gauge in the range 10 to 16, preferably 12, so as to have 10 to 16 wales per inch, preferably 14, in the course-wise direction and 20 to 40 stitches per inch, preferably 30 in the wale-wise direction. The pile component of the chenille yarn may have a decitex in the range 1 denier per filament to 4 denier per filament with a length in the range 1.25 to 2.5 mm, preferably 1.4 to 1.75 mm.

There may be two or more other yarns. The other yarns are preferably air textured polyester yarns, one or more strands of which may be trilobal polyester. The air textured yarns preferably have a yarn to metal coefficient of friction ($\mu$) in the range 0.1 to 0.45.

The chenille yarn preferably has an extensibility in the range of 5% to 15% at half its breaking load. The chenille yarn preferably has a yarn to metal coefficient of friction ($\mu$) of less than 3, preferably 0.2 to 3. A preferred breaking load for the chenille yarn is in the range 750 to 1250 cN/Tex.

Preferably there are no more than six adjacent courses of chenille yarn in any region of the fabric, and further preferably such regions of adjacent courses of chenille yarn are limited to the edges of the fabric. Further preferably, each course of chenille yarn has no more than one course of chenille yarn on either side.

The fabric may be knitted on a flat bed knitting machine having a pair of opposed needle beds. The machine may have a gauge in the range 10 to 16, preferably 10 to 14, further preferably 12. The machine may be a twin cam machine or a three cam or four cam machine.

The present invention also provides a method of knitting an upholstery fabric, in which the knitting is carried out on a machine having a pair of opposed independently operable needle-beds, and in which the needles in each bed can be moved independently of one another in that bed into the path of an operating cam box reciprocatable along the needle beds, in which the fabric is formed from a chenille yarn and a non-chenille yarn, and in which the fabric is characterised in that the chenille yarn is knitted into the fabric.

The method may be used to knit a single jersey structure in which alternate courses are formed of chenille yarn and non-chenille yarn, and in which the chenille yarn in a single course is knitted on alternate needles. Further preferably, the chenille yarn in a first course is knitted on even numbered needles, and the next course to contain chenille yarn is knitted on odd numbered needles.

Further preferably, no more than six courses of chenille yarn are knitted sequentially.

Preferably, the method utilises a machine having a needle gauge in the range 10 to 14, and the method is carried out on a machine having a twin cam box.

Alternatively, the method of knitting the upholstery fabric may be utilised to produce a double jersey structure in which the chenille yarn is knitted with larger loops than the non-chenille yarn. Preferably, the chenille yarn in a double jersey structure is knitted so that no more than two loops of chenille yarn inter-engage within a central region of the knitted structure.

BRIEF DESCRIPTION OF THE DRAWINGS

By way of example, embodiments of the present invention will now be described with reference to the accompanying drawings, of which.

DESCRIPTION OF THE PREFERRED EMBODIMENTS

The invention is preferably carried out on a flat V-bed knitting machine. More details on such knitting machines are to be found in the publication "Dubied Knitting Manual" published by Edward Dubied Company SA, Neuchatel, Switzerland in 1967. Flat V-bed knitting machines are very well known and many such machines are now computer controlled. As mentioned above, proposals have been made—see for example GB-A-2223034—to knit upholstery fabrics suitable for use in vehicles. Upholstery fabrics for vehicles have to be capable of withstanding conditions conventionally met in vehicles. This means that such upholstery fabrics have to be resistant to wear and tear, be attractive in appearance, and retain such appearance over a long period of time. With conventional cut and sew processes, utilising woven fabric, it is necessary to produce the designs for a new fabric for a vehicle some considerable time in advance. Conventional cut and sew techniques are also wasteful of fabric material and very time-consuming in their production process.

A significant advantage of using a knitting technique for the production of upholstery fabrics for vehicles is that there is very little wastage of fibre material—in that the fabric for the cover is produced to the desired shape in a single knitting operation so that all of the yarn utilised in the production of the fabric is utilised directly in the seat.

The inventors have now developed a fabric structure, and a method of making the same which enables a fabric to be produced which can have a soft touch or velour-type feel whilst being produced by knitting methods which enable it to be formed as an upholstery fabric suitable for use in vehicle upholstery seat covers and other upholstery products on fine gauge knitting machines.

The fabrics are produced by knitting with at least one chenille yarn as referred to herein. The elongate core, of the chenille yarn can be formed of any suitable polymeric material such as a polyester or nylon and attached to the core are the pile fibres. The pile fibres again can be produced of any suitable material such as polyester or nylon.

Figure 1:
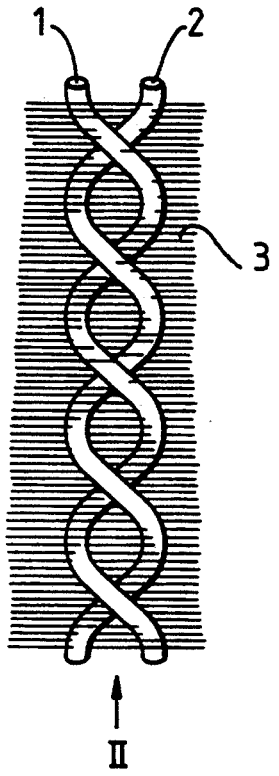
FIG. 1 is a side elevational view of a chenille yarn.
Figure 2:
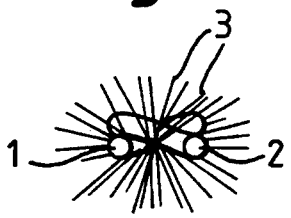
FIG. 2 is an end-view of the yarn of FIG. 1 viewed in the direction of the arrow II.

Referring to FIGS. 1 and 2, these show schematically a preferred form of chenille yarn. The chenille yarn illustrated comprises a pair of polyester core yarns 1, 2, which are twisted together as shown. Trapped between the yarns 1, 2, are short pieces of fibre 3 which form a pile on the yarn. As can be seen in FIG. 2, the pile 3 extends all around the composite chenille yarn as the core yarns 1, 2 are twisted about the longitudinal axis. The yarn illustrated can be produced in numerous ways, for example by simultaneously twisting together yarns 1, 2 while trapping the pile fibres 3 therebetween to form the yarn assembly. In one form of construction, the pile fibres 3 are trapped between the yarns 1, 2 solely by friction resulting from the twisting together of the elongate core yarns 1, 2. In an alternative type of construction, the pile fibres 3 are bonded to the elongate core yarns 1, 2. A preferred method of bonding such a structure together is to provide a third component parallel to one or other of the core yarns 1, 2 which third element is incorporated into the chenille yarn assembly as the yarn is produced. A preferred material for such a third yarn element is a low melting point nylon. Once the chenille yarn assembly has been produced, it can be heated up—for example by the use of steam or hot air—to cause the nylon to soften and to bond the pile fibres 3 to the core yarns 1, 2 of the yarn assembly.

In addition to the use of a chenille yarn in the manufacture of a fabric in accordance with the invention, it is necessary to use a non-chenille or ground yarn. A preferred material for the ground yarn is an air-textured polyester material having a decitex in the range 550 to 900, preferably in the range 650–750. The chenille yarn and the air-textured ground yarn can be of the same colour or of different colours, the pile fibres 3 in the chenille yarn can be of the same colour along the length of the chenille yarn or alternatively may be of differing colours so as to give a melange effect to the eventual knitted product. There may be two or more ground yarns in addition to one or more chenille yarn(s). This is particularly the case with double jersey structures.

In one embodiment of knitting method according to the invention, as illustrated with reference to FIG. 3, a single jersey structure is produced of a fabric suitable for use in an upholstered structure. The fabric can be formed on a 12 gauge knitting machine using a 3350 decitex chenille yarn in which there is a polyester pile and a core of polyester or nylon together with a 700 to 800 decitex air textured polyester yarn as a ground yarn. The machine used to knit the fabric as a single jersey structure is preferably a twin cam machine thus permitting both the chenille yarn and the ground yarn to be knitted in a single pass. With a twin cam machine, the cam box contains two separate cams which can be used to control the needles in two sequential operations as the cam box is traversed across the needle bed. Thus by the use of two yarns and two cams, two courses of fabric can be knitted with a single movement of the cam box.

Figure 3:
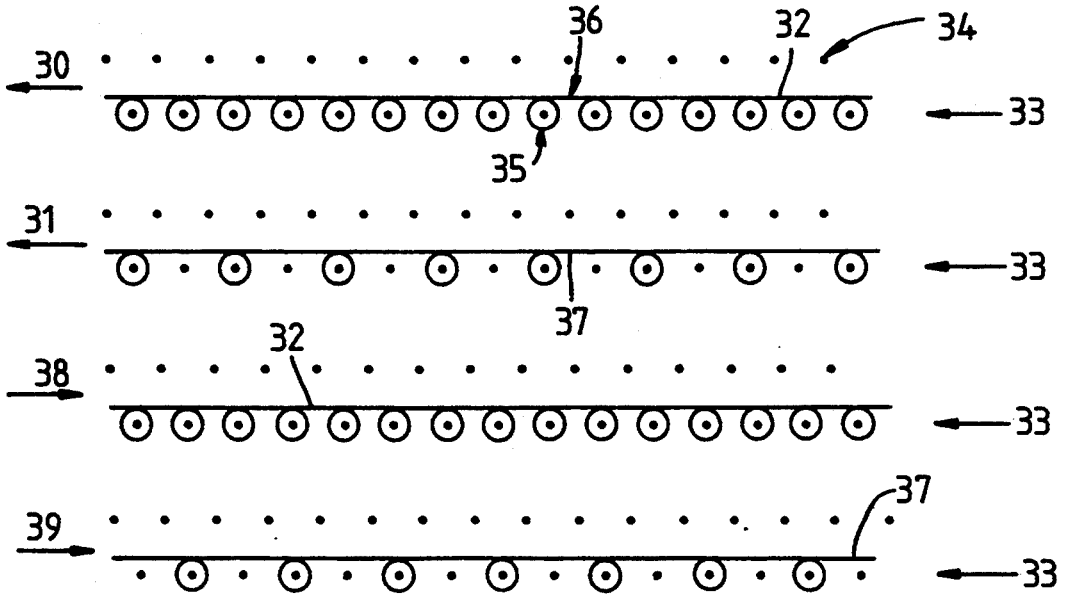
FIG. 3 is a stitch diagram of a knitting sequence to produce a single jersey soft touch fabric.

As shown in FIG. 3, which is a conventional stitch diagram with the needles of the lower and upper beds represented by two rows of dots 33 and 34, respectively, the first passage of the cam in the direction of the arrows 30, 31 knits initially a ground yarn 32 on each of the needles of the lower bed 33. It can be seen that in FIG. 3 the upper bed 34 is never used. This is a characteristic of a single jersey fabric, in which the entire structure can be knitted on a single bed of needles. In a conventional single jersey structure, the technical face of the fabric is produced on the side 35 and the side 36 of the fabric is the technical reverse of the fabric. In single jersey garment fabrics, the technical face 35 is also the aesthetic surface in the sense that that is the face on the outside of the garment seen by viewers of the garment.

After the ground yarn 32 has been knitted on all of the needles on the lower needle bed 33, a chenille yarn 37 is knitted on alternate, (odd numbered) needles on the lower needle bed 33. The term lower needle bed indicates the lower bed in the drawing—it may normally be considered as the front bed (nearer the operator) with the upper bed 34 being regarded as the back bed. Preferably the cam is set so as to form slightly longer loops from the chenille yarn compared to the loops produced from the ground yarn. After the chenille yarn 37 has been knitted, the cam box will be at the extreme left of the needle bed as illustrated in FIG. 3.

On the reverse movement of the cam in the direction of arrows 38, 39, a further course of the ground yarn 32 is knitted on the lower needle bed 33, followed by a further course of the chenille yarn 37, this time on the alternate even numbered needles on the lower needle bed 33.

This sequence of four courses may be repeated indefinitely to produce a structure formed of a combination of the chenille yarn and the ground yarn. It has been found that the chenille yarn is fully locked into the structure, but the pile of the chenille yarn effectively appears only on the face 36 of the fabric produced by this knitting sequence. This means that the face 36 has a velour type feel but the face 35 is almost devoid of pile.

The effect of this is that the technical reverse of the fabric 36 then becomes the aesthetic surface of the fabric. Importantly the more expensive chenille yarn is incorporated into the fabric so that the majority of the expensive pile is released onto the aesthetic surface of the fabric. The single jersey structure may be formed as a planar fabric or may be knitted as a box structure. It will be appreciated that two parallel single jersey layers could be produced on the front and rear beds 33, 34 simultaneously, without any interconnecting loops so that provided the two edges of the fabric are interconnected, a tube would be produced. Thus it would be possible for the fabric to be knitted so that when the cam box is moved in the direction of arrows 30, 31, all knitting takes place on the needle beds 33. However, when the cam box is moved in the direction of arrows 38, 39, all knitting takes place on the needle bed 34. Provided that at the end of each stroke the yarns are looped from one needle bed to the other, a tubular structure will be produced. Such a structure may be used, for example, to upholster both faces of the back of a chair.

The chenille yarn 37 used in the production of a single jersey fabric is preferably of a relatively high count—3000 to 5000 decitex—so that the fabric has an upholstery weight. The chenille yarn may be of the type in which the pile is held only by friction between the pairs of strands 1, 2 forming the elongate portion of the yarn. In such a structure, the 12 gauge needles are able to make contact with and pull the elongate longitudinal core of the chenille yarn so as to spread the pile 3 so that the loop forming the stitches is made on the core of the yarn only. This further increases the efficiency of use of the chenille yarn in that by pulling only the core to the technical face of the yarn, the pile is left in the portions of the chenille yarn on the technical reverse, which forms the aesthetic face of the fabric. This means that very heavy chenille yarns can be knitted which lock the chenille yarn firmly into the fabric and use the chenille yarn at very high efficiency rates in terms of percentage of pile apparent on the aesthetic surface of the fabric.

Although single jersey fabrics have many uses, for three dimensional knitted upholstery fabrics it is in many cases highly desirable to produce a double jersey structure. Double jersey structures tend to be heavier in weight and have the ability to be formed with integral attachment features. Furthermore, much greater possibilities of patterning and coloration occur with double jersey structures than are possible with single jersey structures. An important feature of the present invention, therefore, is the ability to utilise the invention to knit double jersey fabrics having a velour type appearance and feel on one side of the double jersey fabric (within any given region).

Figure 4:
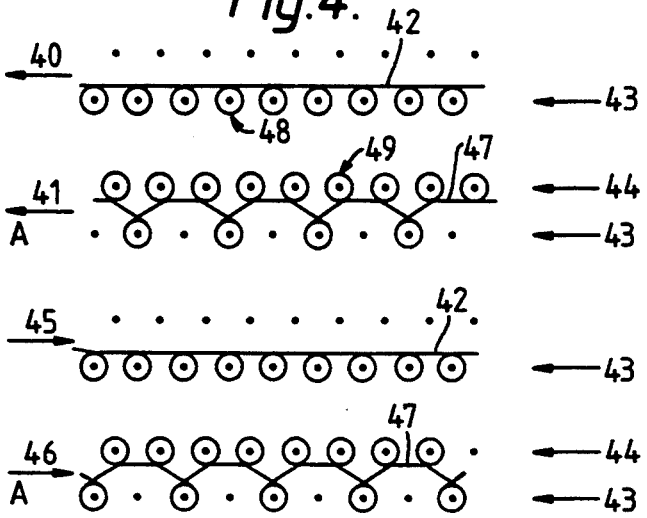
FIG. 4 is a stitch diagram of a knitting sequence to produce a double jersey soft touch fabric.

Referring to FIG. 4 this shows a knitting sequence for one form of double jersey structure formed of a chenille yarn and a ground yarn. Again, the double jersey fabric is produced on a 12 gauge flat V-bed knitting machine but in this case the chenille yarn used is of 1440 decitex and is of the type in which the pile of the yarn is locked into the yarn by means of some bonding method e.g. the bonding method which incorporates a low melting point strand in with one of the elongate core yarns so that after the production of the chenille yarn, heating of the yarn above the softening point of the low melting point strand causes the strand to melt or soften and, on cooling, to lock in the pile.

Such bonded yarns may be knitted in the bonded or unbonded condition, with the bonding of the pile into the yarn occurring either prior to knitting, or after the structure has been knitted (e.g. in a subsequent steaming operation).

Lower decitex chenille yarns are possible with double jersey fabrics because the use of a double jersey structure gives an enhanced weight to the fabric.

As illustrated in FIG. 4, the fabric is produced using a double cam system and knitting both a chenille yarn 42 and a ground yarn 47 in a single pass, sequentially on needles of a lower bed 43 and an upper bed 44.

In the first pass of the cam box from right to left, in the direction of arrows 40, 41, the chenille yarn 42 is knitted on the needles in the lower needle bed 43. The chenille yarn in this case is knitted on all of the needles in the lower needle bed. In the same pass of the cam box, in the direction of arrow 41, an air textured polyester ground yarn 47 having a decitex of about 750, is knitted as shown. In this case the polyester ground yarn is knitted on all of the needles in the upper needle bed 44 and on alternate, even numbered, needles in the lower needle bed 43.

On the reverse movement of the cam box from left to right in the direction of arrows 45, 46, the chenille yarn 42 is again knitted on all of the needles in the lower needle bed 43. The ground yarn 47 is, however, knitted on only the alternate, odd numbered, needles on the lower bed 43 but again is knitted on all of the needles in the upper bed 44.

Again, the structure of the four courses shown in FIG. 4 is repeated to whatever extent is required so as to produce a heavy duty double jersey fabric having a soft touch feel. The face 48 of the fabric has the velour type feel and the face 49 of the fabric has a harder, polyester type feel. Again, it will be appreciated that the majority of the pile of the chenille yarn is released for effect on the face 48 with very little of the pile being apparent on the face 49 of the double jersey structure. It can be seen that on the rear needle bed, 100% of the stitches are formed of the polyester ground yarn. On the front needle beds 67% of the stitches are formed of chenille yarn and 33% are formed of the polyester ground yarn. Again, the stitches of the chenille yarn are knitted slightly slacker—having slightly larger loops—than the polyester yarn. On a Stoll knitting machine the ratio of the stitch length between the polyester and chenille yarns is typically from 10.3 to 11.5. This takes the proportion of the pile of the chenille yarn which appears on the front loops to the region 80 to 90%. Again, this means that a very high percentage of the more expensive chenille yarn is utilised in producing the velour effect on the fabric. Very little of the pile of the more expensive chenille type yarn is, therefore, lost in the internal structure of the fabric. A further advantage of the knitting method described is that the chenille yarn is firmly locked into the fabric and the fabric thus has a very good wear resistance.

In the Taber test using CS10 wheels with a load of 1000 gms applied over 1000 cycles, a fabric produced in accordance with the present invention had approximately the same wear characteristics as a woven velour. On a scale of 1 to 5, with 1 being catastrophic failure, 3 being a pass and 5 being no broken threads or disturbance of the fabric, fabrics produced in accordance with the stitch diagram of FIG. 4 consistently attained a rating of 4 to 5.

The structure illustrated in FIG. 4 is essentially a single colour structure, although if chenille yarn and ground yarn of different colours are used, two colours will be apparent.

Of particular interest, however, is the production of two colour jacquard patterned fabrics—which may be toned with a third colour being the colour of the chenille yarn. For the economic production of such a fabric, a three cam system knitting machine is preferred—such a machine has a higher productivity in the production of this type of two colour jacquard patterning than a two cam machine. With a two cam machine the cam box has to make a number of blank passes to ensure that the yarns are in the correct position during knitting.

Figure 5:
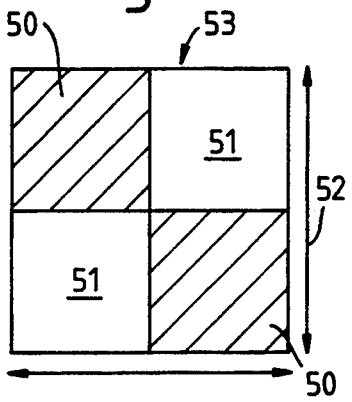
FIG. 5 is a schematic view of a chequer board soft touch fabric in two different colours.

FIG. 5 illustrates schematically a section of fabric 53, eight needles in width, having two differently coloured regions 50, 51. The four regions illustrated are, in total, eight complete jacquard face courses high, with an additional sixteen, interspaced, complete chenille face courses, as illustrated by line 52. A complete face course is one in which all the needles on a particular face which are required to be knitted on are knitted on before the next line of the jacquard is executed.

Figure 6:
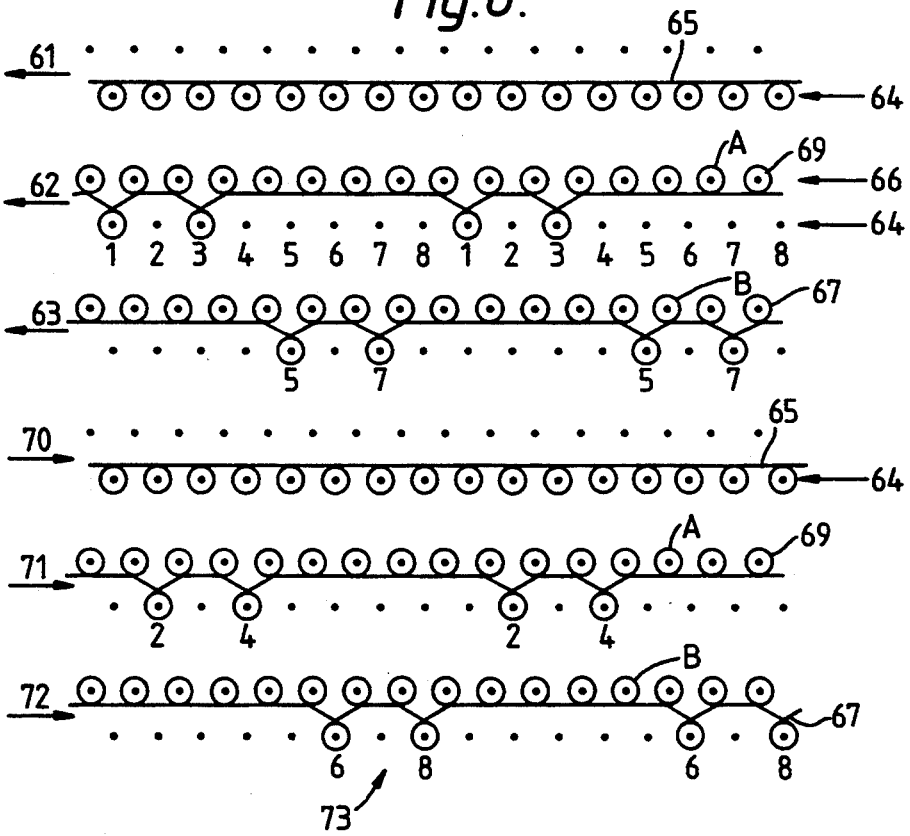
FIG. 6 is a stitch diagram of a knitting sequence used to produce the structure illustrated in FIG. 5.

The knitting sequence required to produce such a structure is illustrated, in part, in FIG. 6. FIG. 6 shows the production of one complete face course of the jacquard design (formed in stitch row directions 62, 63, 71, 72 from four partial courses) interspaced by two complete face courses of chenille yarn (formed in stitch row directions 61, 70) on needles of a lower bed 64 and an upper bed 66.

The first three complete and partial courses shown in FIG. 6 are produced by the movement of the cam box from right to left as illustrated by arrows 61, 62 and 63. The movement of the cam box from right to left produces a first complete course, of a chenille yarn 65 knitting on each of the needles in the lower bed 64. Subsequently, during the same passage of the cam box in the direction of arrow 62, an air textured polyester yarn 69 of a first colour, indicated by the letter A, is knitted on all of the needles in the upper needle bed 66 and on needles 1 and 3 of an eight needle repeat on the lower needle bed 64. Thus the yarn 69 can be seen to knit on two needles, 3, 1 in the second course shown in FIG. 6, to produce a complete course on the needles of the upper bed and a partial course on the needles of the lower bed.

Again, during the same movement of the cam box from right to left in the direction of arrow 63, a second air textured polyester yarn 67 of colour B different to colour A is again knitted n all of the needles in the upper needle bed 66 and on needles 5 and 7 in the eight needle sequence in the lower needle bed 64.

The counts of the yarns 65: 67, 69 used to knit the structure shown in FIG. 6 can be the same as the counts of the yarns 42, 47 used to knit the structure shown in FIG. 4.

On the reverse movement of the cam box in the direction of arrows 70, 71 and 72, the chenille yarn 65 is knitted on all of the needles in the lower needle bed 64 to produce a complete chenille course. Subsequently, the ground yarn 69 is knitted on all of the needles of the upper bed 66 and on needles 2 and 4 of the eight needle sequence on the lower bed 64.

Finally, again during the same movement of the cam box in the direction of arrow 72, the polyester ground yarn 67 is knitted on all of the needles in the upper needle bed and on needles 6 and 8 in the eight needle sequence on the lower needle bed.

With a structure as created by the knitting sequence of FIG. 6 a chenille yarn has only to be pulled through one chenille loop before being interconnected into the structure by a non-chenille polyester yarn. Chenille yarns being brush-like in their character build up considerable friction in the passage of one chenille yarn through another. Thus using the invention produces an advantage in that it is not necessary to continually interconnect chenille loops.

It can be seen from FIG. 6 that the chenille yarn 65 exists primarily on the face 73 of the fabric. This then becomes the aesthetic surface of the fabric. It can also be seen that yarn 69 of colour A only appears on the front face 73 in the region knitted by needles 1 to 4 and yarn 67 of colour B is knitted only in the region of needles 5 to 8. Thus on the eight stitches produced by needles 1 to 8, the left hand four will have revealed on its face colour A and the right hand four will have on its face colour B. Thus if colour A is darker than colour B, the portion of fabric produced by the needles 1 to 4 will be equivalent to the portion 50 shown in FIG. 5 and the portion of the fabric produced on needles 5 to 8 will be the portion 51. To alter the colour of the chequer work pattern as shown in FIG. 5, the cams can be varied during knitting so as to alter the knitting sequence to the effect that yarn of colour A is knitted on needles 5 to 8 and yarn of colour B is knitted on needles 1 to 4.

It will be appreciated that using the sequence of FIG. 6 it requires six courses to be knitted to produce a complete face colour. With the sequence shown in FIG. 7, a complete face course of colour is produced with only three courses. This sequence also has the effect of spacing the chenille yarn courses further apart, thus for a given area of fabric less chenille yarn courses are used. The fabric also has slightly increased stretch characteristics compared to the fabric produced by the sequence of FIG. 6, and although using less chenille yarn, the fabric is regarded by some evaluators as having a softer handle. These changes are a result of knitting on more of the front needles with the coloured ground yarns. In the sequence shown in FIG. 7 chenille yarn 65 is knitted on all of the front or lower needles in bed 64 when the knitting occurs on movement of the cam box in the direction of arrow 61. The next course of knitting is carried out with yarn of colour A, which is knitted again in the same direction, (see arrow 62) on all of the needles of the rear bed and on needles 4 to 1 of the front bed. Yarn of colour B is then knitted in the same direction, (see arrow 63) on all of the needles of the rear bed and on needles 8 to 5 of the front bed. The same sequence is then knitted again when the cam box is reversed and moves in the direction of arrows 70, 71 and 72.

Figure 7:
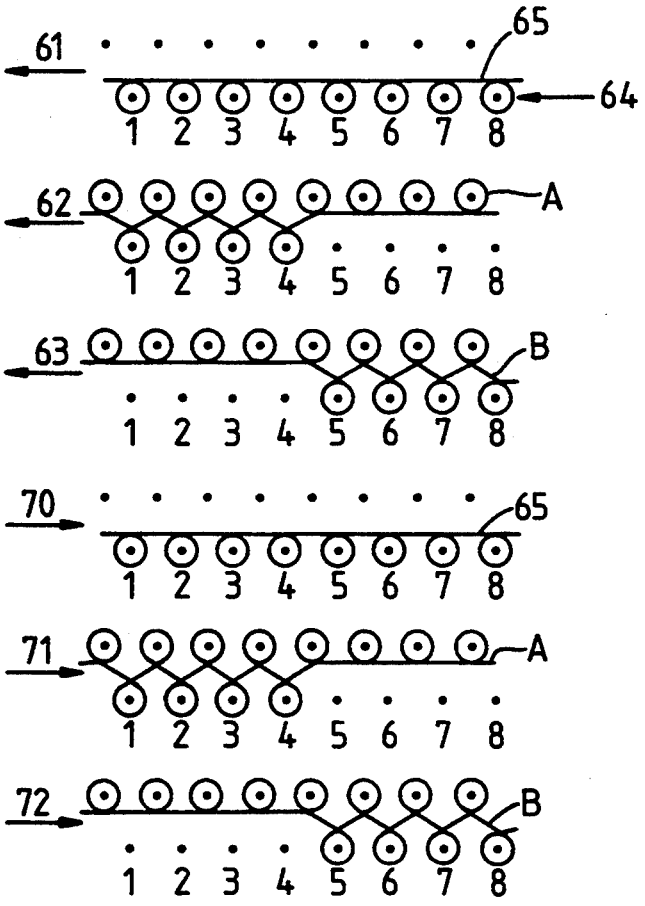
FIG. 7 is a modified form of knitting sequence to that of FIG. 6, and FIGS. 8 and 9 are stitch diagrams of alternative structures.

The sequence of FIG. 7 produces, additionally, a fabric having a brighter colour than that of FIG. 6.

Figure 8:
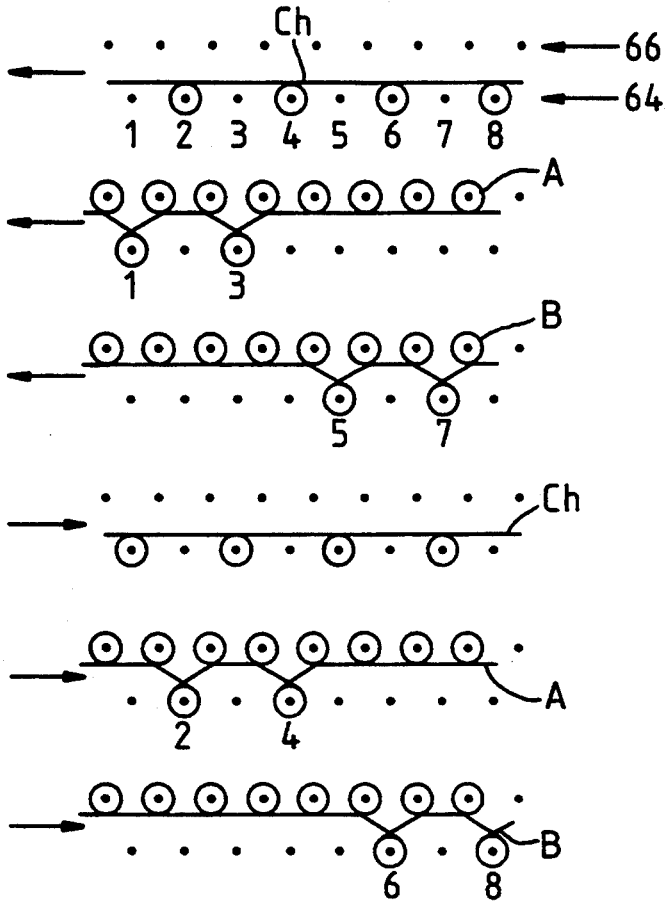

FIG. 8 shows a modified six course knitting sequence which is similar to that of FIG. 6 but in which the chenille yarn Ch is knitted only on alternate needles of the front bed 64 in each of the first and fourth courses shown.

Figure 9:
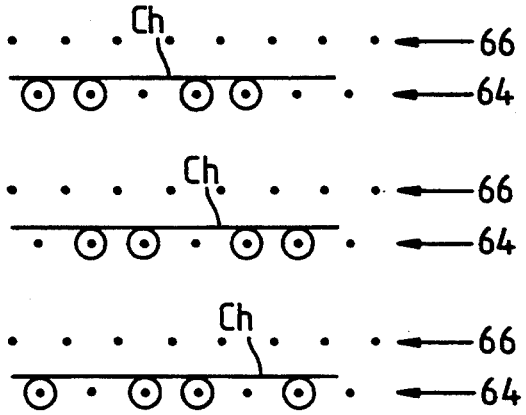

FIG. 9 shows a further desired knitting routine for the rows of chenille yarn. Only the chenille yarn is shown in FIG. 9 but the other rows of ground yarns of colours A and B follow the sequence as demonstrated in FIG. 6. The routine will produce a twill-like face.

It will also be appreciated that for patterning purposes the chenille yarn Ch may be knitted on the rear needles and the pattern effectively turned inside out. This means that within a velour fabric, regions of flat structure can be produced with the chenille yarn on the rear for patterning purposes.

Preferably, the count of the ground yarn is half or less than half of the count of the chenille yarn. The significance of this is that the total yield of the fabric produced on the front and rear beds is then approximately balanced so that the fabric lies very flat. This enables the three dimensional shaping of the fabric using the techniques described in the patent specifications previously referred to to be produced more readily.

A fabric in accordance with this invention makes very efficient use of chenille yarns and has a stretchability of about 10% in both course- and wale-wise directions. This is compared to a process in which a chenille yarn is inlaid into the fabric. In such a fabric there is very little extensibility of the fabric. Furthermore, with an inlaid process, the expensive chenille yarn is largely hidden within the core of the fabric and its pile is not released to the surface to give a velour touch in the same way as with the structures of the present invention.

Furthermore, a fabric in accordance with the invention in its preferred form has relatively flat faces as a result of the large number of stitches produced on the faces.

Although the fabric may be produced by incorporating tuck stitches into the fabric—particularly tucked stitches of chenille yarn, these tuck stitches have been found to be vulnerable to wear and picking in use. Thus a minimal number of tuck stitches is preferable for a high wearing structure. A structure predominantly containing tucked stitches of chenille yarn over a large area does not have the advantages of the present invention in which predominantly the chenille yarn is knitted into the fabric to form a part of the fabric with the chenille yarn forming interengaging loops within the fabric.

In very localised regions it is possible to permit up to six or possibly even more courses of fabric to be produced in which the chenille yarn(s) interengage one with the other. Much beyond this, however, it has been found that the strain built up in the fabric is such as to produce a bursting open or breaking of the stitches in an unacceptable manner for commercial production. By the present invention there is provided a means for producing an acceptable fabric which can be produced commercially in a way which has not been suggested or indicated heretofore.

Very surprisingly it has been discovered that the fabrics of the invention can be formed to have an increasing softness to the touch by reducing the amount of chenille yarn incorporated into the fabric. By way of example, an original knitting sequence (1) having a high content of chenille yarn was compared with a series of seven other knitting sequences (2 to 7) which gave fabrics with reduced quantities of chenille yarn. In the sequences set out below, the content of each course of knitting will first be described, then the programming sequence, which is carried out on a three system jacquard machine, and is repeated for however many courses as are required. Subsequently the usage of chenille yarn is given and is compared to the usage of sequence 1.

| Original Sequence (1) | |
|---|---|
| Course 1 | |
| Yarn reference: | Chenille yarn. |
| Rear needle bed: | out of action. |
| Front needle bed: | Knit all needles. |
| Course 2 | |
| Yarn reference: | Colour A ground yarn. |
| Rear needle bed: | Knit all needles. |
| Front needle bed: | As selected by jacquard. |
| Course 3 | |
| Yarn reference: | Colour B ground yarn. |
| Rear needle bed: | Knit all needles. |
| Front needle bed: | As selected by jacquard. |

Example Programming Sequence
Three System Machine.

| | | | |
|---|---|---|---|
| → | 3 | 2 | 1 |
| ← | 1 | 2 | 3 |

-continued

| Sequence (2) | |
|---|---|
| Course 1 | |
| Yarn reference: | Chenille yarn. |
| Rear needle bed: | Out of action. |
| Front needle bed: | Knit only odd needles. |
| Course 2 | |
| Yarn reference: | Colour A ground yarn. |
| Rear needle bed: | Knit all needles. |
| Front needle bed: | As selected by jacquard. |
| Course 3 | |
| Yarn reference: | Colour B ground yarn. |
| Rear needle bed: | Knit all needles. |
| Front needle bed: | As selected by jacquard. |
| Course 4 | |
| Yarn reference: | Chenille yarn. |
| Rear needle bed: | Out of action. |
| Front needle bed: | Knit only even needles. |
| Course 5 | |
| Yarn reference: | Colour A ground yarn. |
| Rear needle bed: | Knit all needles. |
| Front needle bed: | As selected by jacquard. |
| Course 6 | |
| Yarn reference: | Colour B ground yarn. |
| Rear needle bed: | Knit all needles. |
| Front needle bed: | As selected by jacquard. |

Example Programming Sequence
Three System Machine.

| | | | |
|---|---|---|---|
| → | 3 | 2 | 1 |
| ← | 4 | 5 | 6 |

| Approximate Usage of Chenille Yarn | |
|---|---|
| Cone weight (g.): | |
| Before knitting: | 210 |
| After knitting: | 200 |
| Chenille yarn used: | 10 |
| Compared to Sequence 1. | 71% |

| Sequence (3) | |
|---|---|
| Course 1 | |
| Yarn reference: | Chenille yarn. |
| Rear needle bed: | Out of action. |
| Front needle bed: | Knit all needles. |
| Course 2 | |
| Yarn reference: | Colour A ground yarn. |
| Rear needle bed: | Knit all needles. |
| Front needle bed: | As selected by jacquard. |
| Course 3 | |
| Yarn reference: | Colour B ground yarn. |
| Rear needle bed: | Knit all needles. |
| Front needle bed: | As selected by jacquard. |
| Course 4 | |
| Yarn reference: | Chenille yarn. |
| Rear needle bed: | Out of action. |
| Front needle bed: | Knit all needles. |
| Course 5 | |
| Yarn reference: | Colour A ground yarn. |
| Rear needle bed: | Knit all needles. |
| Front needle bed: | As selected by jacquard. |
| Course 6 | |
| Yarn reference: | Colour B ground yarn. |
| Rear needle bed: | Knit all needles. |
| Front needle bed: | As selected by jacquard. |
| Course 7 | |
| Yarn reference: | Colour A ground yarn. |
| Rear needle bed: | Knit all needles. |
| Front needle bed: | As selected by jacquard. |
| Course 8 | |
| Yarn reference: | Colour B ground yarn. |
| Rear needle bed: | Knit all needles. |
| Front needle bed: | As selected by jacquard. |
| Course 9 | |
| Yarn reference: | Colour A ground yarn. |
| Rear needle bed: | Knit all needles. |
| Front needle bed: | As selected by jacquard. |
| Course 10 | |
| Yarn reference: | Colour B ground yarn. |

-continued

| | |
|---|---|
| Rear needle bed: | Knit all needles. |
| Front needle bed: | As selected by jacquard. |

Example Programming Sequence
Three System Machine.

| | | | |
|---|---|---|---|
| → | 3 | 2 | 1 |
| ← | 4 | 5 | 6 |
| → | — | 8 | 7 |
| ← | — | 9 | 10 |

Approximate Usage of Chenille Yarn

| Cone weight (g.): | |
|---|---|
| Before knitting: | 200 |
| After knitting: | 192 |
| Chenille yarn used: | 8 |
| Compared to Sequence 1. | 51% |

Sequence (4)

| | |
|---|---|
| Course 1 | |
| Yarn reference: | Chenille yarn |
| Rear needle bed: | Out of action. |
| Front needle bed: | Knit only odd needles. |
| Course 2 | |
| Yarn reference: | Colour A ground yarn. |
| Rear needle bed: | Knit all needles. |
| Front needle bed: | As selected by jacquard. |
| Course 3 | |
| Yarn reference: | Colour B ground yarn. |
| Rear needle bed: | Knit all needles. |
| Front needle bed: | As selected by jacquard. |
| Course 4 | |
| Yarn reference: | Chenille yarn. |
| Rear needle bed: | Out of action. |
| Front needle bed: | Knit only even needles. |
| Course 5 | |
| Yarn reference: | Colour A ground yarn. |
| Rear needle bed: | Knit all needles. |
| Front needle bed: | As selected by jacquard. |
| Course 6 | |
| Yarn reference: | Colour B ground yarn. |
| Rear needle bed: | Knit all needles. |
| Front needle bed: | As selected by jacquard. |
| Course 7 | |
| Yarn reference: | Colour A ground yarn. |
| Rear needle bed: | Knit all needles. |
| Front needle bed: | As selected by jacquard. |
| Course 8 | |
| Yarn reference: | Colour B ground yarn. |
| Rear needle bed: | Knit all needles. |
| Front needle bed: | As selected by jacquard. |
| Course 9 | |
| Yarn reference: | Colour A ground yarn. |
| Rear needle bed: | Knit all needles. |
| Front needle bed: | As selected by jacquard. |
| Course 10 | |
| Yarn reference: | Colour B ground yarn. |
| Rear needle bed: | Knit all needles. |
| Front needle bed: | As selected by jacquard. |

Example Programming Sequence
Three System Machine.

| | | | |
|---|---|---|---|
| → | 3 | 2 | 1 |
| ← | 4 | 5 | 6 |
| → | — | 8 | 7 |
| ← | — | 9 | 10 |

Approximate Usage of Chenille Yarn

| Cone weight (g.): | |
|---|---|
| Before knitting: | 192 |
| After knitting: | 187 |
| Chenille yarn used: | 5 |
| Compared to Sequence 1. | 37% |

Sequence (5)

| | |
|---|---|
| Course 1 | |
| Yarn reference: | Chenille yarn. |
| Rear needle bed: | Out of action. |
| Front needle bed: | Knit all needles. |
| Course 2 | |

-continued

| | |
|---|---|
| Yarn reference: | Colour A ground yarn. |
| Rear needle bed: | Knit all needles. |
| Front needle bed: | As selected by jacquard. |
| Course 3 | |
| Yarn reference: | Colour B ground yarn. |
| Rear needle bed: | Knit all needles. |
| Front needle bed: | As selected by jacquard. |
| Course 4 | |
| Yarn reference: | Colour A ground yarn. |
| Rear needle bed: | Knit all needles. |
| Front needle bed: | As selected by jacquard. |
| Course 5 | |
| Yarn reference: | Colour B ground yarn. |
| Rear needle bed: | Knit all needles. |
| Front needle bed: | As selected by jacquard. |
| Course 6 | |
| Yarn reference: | Colour A ground yarn |
| Rear needle bed: | Knit all needles. |
| Front needle bed: | As selected by jacquard. |
| Course 7 | |
| Yarn reference: | Colour B ground yarn. |
| Rear needle bed: | Knit all needles. |
| Front needle bed: | As selected by jacquard. |

Example Programming Sequence
Three System Machine.

| | | | |
|---|---|---|---|
| → | 3 | 2 | 1 |
| ← | 4 | 5 | — |
| → | 7 | 6 | — |
| ← | 1 | 2 | 3 |
| → | — | 5 | 4 |
| ← | — | 6 | 7 |

Approximate Usage of Chenille Yarn

| Cone weight (g.): | |
|---|---|
| Before knitting: | 187 |
| After knitting: | 182 |
| Chenille yarn used: | 5 |
| Compared to Sequence 1. | 34% |

Sequence (6)

| | |
|---|---|
| Course 1 | |
| Yarn reference: | Chenille yarn. |
| Rear needle bed: | Out of action. |
| Front needle bed: | Knit all needles. |
| Course 2 | |
| Yarn reference: | Colour A ground yarn. |
| Rear needle bed: | Knit all needles. |
| Front needle bed: | As selected by jacquard. |
| Course 3 | |
| Yarn reference: | Colour B ground yarn. |
| Rear needle bed: | Knit all needles. |
| Front needle bed: | As selected by jacquard. |
| Course 4 | |
| Yarn reference: | Chenille yarn. |
| Rear needle bed: | Knit needles 1, 5, 9, etc. |
| Front needle bed: | Out of action. |
| Course 5 | |
| Yarn reference: | Colour A ground yarn. |
| Rear needle bed: | Knit all needles. |
| Front needle bed: | As selected by jacquard. |
| Course 6 | |
| Yarn reference: | Colour B ground yarn. |
| Rear needle bed: | Knit all needles. |
| Front needle bed: | As selected by jacquard. |
| Course 7 | |
| Yarn reference: | Chenille yarn. |
| Rear needle bed: | Out of action. |
| Front needle bed: | Knit all needles. |
| Course 8 | |
| Yarn reference: | Colour A ground yarn. |
| Rear needle bed: | Knit all needles. |
| Front needle bed: | As selected by jacquard. |
| Course 9 | |
| Yarn reference: | Colour B ground yarn. |
| Rear needle bed: | Knit all needles. |
| Front needle bed: | As selected by jacquard. |
| Course 10 | |

-continued

| | |
|---|---|
| Yarn reference: | Chenille yarn. |
| Rear needle bed: | Knit needles 3, 7, 11, etc. |
| Front needle bed: | Out of action. |
| Course 11 | |
| Yarn reference: | Colour A ground yarn. |
| Rear needle bed: | Knit all needles. |
| Front needle bed: | As selected by jacquard. |
| Course 12 | |
| Yarn reference: | Colour B ground yarn. |
| Rear needle bed: | Knit all needles. |
| Front needle bed: | As selected by jacquard. |

Example Programming Sequence
Three System Machine.

| | | | |
|---|---|---|---|
| → | 3 | 2 | 1 |
| ← | 4 | 5 | 6 |
| → | 9 | 8 | 7 |
| ← | 10 | 11 | 12 |

Approximate Usage of Chenille Yarn

| | |
|---|---|
| Cone weight (g.): | |
| Before knitting: | 162 |
| After knitting: | 150 |
| Chenille yarn used: | 11 |
| Compared to Sequence 1. | 78% |

Sequence (7)

| | |
|---|---|
| Course 1 | |
| Yarn reference: | Chenille yarn. |
| Rear needle bed: | Out of action. |
| Front needle bed: | Knit only odd needles. |
| Course 2 | |
| Yarn reference: | Colour A ground yarn. |
| Rear needle bed: | Knit all needles. |
| Front needle bed: | As selected by jacquard. |
| Course 3 | |
| Yarn reference: | Colour B ground yarn. |
| Rear needle bed: | Knit all needles. |
| Front needle bed: | As selected by jacquard. |
| Course 4 | |
| Yarn reference: | Chenille yarn. |
| Rear needle bed: | Knit needles 1, 5, 9, etc. |
| Front needle bed: | Out of action. |
| Course 5 | |
| Yarn reference: | Colour A ground yarn. |
| Rear needle bed: | Knit all needles. |
| Front needle bed: | As selected by jacquard. |
| Course 6 | |
| Yarn reference: | Colour B ground yarn. |
| Rear needle bed: | Knit all needles. |
| Front needle bed: | As selected by jacquard. |
| Course 7 | |
| Yarn reference: | Chenille yarn. |
| Rear needle bed: | out of action. |
| Front needle bed: | Knit only even needles. |
| Course 8 | |
| Yarn reference: | Colour A ground yarn. |
| Rear needle bed: | Knit all needles. |
| Front needle bed: | As selected by jacquard. |
| Course 9 | |
| Yarn reference: | Colour B ground yarn. |
| Rear needle bed: | Knit all needles. |
| Front needle bed: | As selected by jacquard. |
| Course 10 | |
| Yarn reference: | Chenille yarn. |
| Rear needle bed: | Knit needles 3, 7, 11, etc. |
| Front needle bed: | Out of action. |
| Course 11 | |
| Yarn reference: | Colour A ground yarn. |
| Rear needle bed: | Knit all needles. |
| Front needle bed: | As selected by jacquard. |
| Course 12 | |
| Yarn reference: | Colour B ground yarn. |
| Rear needle bed: | Knit all needles. |
| Front needle bed: | As selected by jacquard. |

Example Programming Sequence
Three System Machine.

-continued

| | | | |
|---|---|---|---|
| → | 3 | 2 | 1 |
| ← | 4 | 5 | 6 |
| → | 9 | 8 | 7 |
| ← | 10 | 11 | 12 |

Approximate Usage of Chenille Yarn

| | |
|---|---|
| Cone weight (g.): | |
| Before knitting: | 171 |
| After knitting: | 161 |
| Chenille yarn used: | 10 |
| Compared to Sequence 1. | 65% |

Compared to original Sequence 1, the further Sequences 2 to 7 give the following benefits. Each of the further Sequences uses less of the chenille yarn, which is more expensive than the base or ground yarns. This results in a lower cost for the fabric. The lower amount of chenille yarn used leads to a reduction in the number of knots in the system and to a reduced knitting time. Three system machines are able to knit more rapidly than two system machines. The sequences 2 to 7 give a brighter jacquard effect on the front face and a greater range of fabric handles as well as, in some cases, a softer apparent touch. It is also possible to use 700 decitex air textured yarns as the colour or ground yarn and, therefore, it is not necessary to use finer counts for the chenille yarn. The fabric has an improved compliability compared to the fabric produce by original Sequence 1.

The chenille yarns used preferably have a denier per filament for the pile component in the range 1 to 4 denier per filament. A preferred decitex for the chenille yarns is in the range 1400 to 1700 decitex but decitexes up to 2000 plus may be used. Typically the coloured ground yarn (i.e. the non-chenille yarn) can have a decitex down to 500 decitex and may be formed of 200 to 300 filaments each filament having a decitex in the range 2 to 3. Alternatively, the coloured ground yarn may be formed from microfibres having an individual decitex of less than 1 denier per filament—typically 0.5 deniers per filament. A suitable number of individual filaments is then air textured together to produce the ground yarn. Because of the amount of movement required from the yarns during the knitting sequence, it is preferred that the coefficient of friction of the yarns be kept as low as possible. For the air textured polyester ground yarn the coefficient of friction ($\mu$ yarn/metal) is preferably in the range 0.15 to 0.25. A preferred maximum for the polyester air textured ground yarn is $\mu=0.45$. By their very nature chenille yarns have a high coefficient of friction compared to the air textured polyester ground yarns and in this case the coefficient of friction ($\mu$ yarn/metal) is preferably less than 3 with a preferred range of 0.25 to 3.

As well as the coefficient of friction of the yarn, it is preferred that the yarn be relatively elastic. An elasticity of 5% to 15%, preferably 5% to 8% extension at half the breaking load is preferred. Typically the breaking load for a preferred chenille yarn would be about 1,000 centinewtons with an elasticity of 7% at a load of 500 centinewtons.

When forming the yarns into three dimensionally knitted structures, particularly where sutures are provided, it is preferred that the chenille yarns are not exposed in the suture regions to avoid excessive wear of exposed stitches. Therefore, it is preferred to use a non-chenille yarn for the exposed stitches.

We claim:

1. A weft knitted upholstery fabric in which the fabric incorporates a ground yarn and a chenille yarn, the chenille yarn and ground yarn being present in the fabric as full loop stitches, each stitch comprising only one of the chenille yarn and the ground yarn.

2. A knitted fabric as claimed in claim 1 in which the fabric is a single jersey fabric and the chenille yarn has a decitex in the range 2000 to 5000.

3. A knitted fabric as claimed in claim 1 in which the ground yarn is an air-textured polyester yarn having a decitex in the range 550 to 900.

4. A knitted fabric as claimed in claim 1, in which no chenille yarn stitch has more than six adjacent chenille stitches in a wale-wise direction.

5. A knitted fabric as claimed in claim 1 in which the fabric is a double jersey fabric, formed of two layers interlinked by mutually engaging stitches.

6. A knitted fabric as claimed in claim 5 in which the chenille yarn has a decitex in the range 1000 to 2500 and the ground yarn has a decitex in the range 500 to 800.

7. A knitted fabric as claimed in claim 6 in which the fabric has 10 to 16 stitches per inch in the course-wise direction and 20 to 40 stitches per inch in the wale-wise direction.

8. A knitted fabric as claimed in claim 7 in which the chenille yarn has a yarn to metal coefficient of friction in the range 0.2 to 3 and the ground yarn is an air textured polyester yarn having a yarn to metal coefficient of friction in the range 0.1 to 0.45.

9. A knitted fabric as claimed in claim 8 in which the chenille yarn has an extensibility in the range 5% to 15% at a load of half the breaking strain thereof.

10. A knitted fabric as claimed in claim 9 in which the chenille yarn is formed of a core of elongate polyester or nylon and low melting point nylon strands with a polyester pile.

11. A knitted fabric as claimed in claim 10 in which the polyester pile has a fibre count in the range of 1 to 4 denier per filament and length in the range 1.25 mm to 1.75 mm.

12. A fabric as claimed in claim 15 in which the chenille yarn has a count in the range 1000 to 2000 decitex, the or each other yarn has a count in the range 600 to 800 decitex, and the fabric has been knitted on a machine having a gauge in the range 10 to 16, so as to have 10 to 16 wales per inch in the course-wise direction and 20 to 40 stitches per inch in the wale-wise direction.

13. A method of knitting an upholstery fabric on a machine having a pair of opposed independently operable needle beds and in which the needles in each bed can be moved independently of one another in that bed into the path of an operating cam box having a double cam system and which is reciprocatable along the needle beds, said method including knitting said fabric from a chenille yarn and a non-chenille yarn and in the knitting process forming the chenille yarn and the non-chenille yarn into full loop stitches comprising only one of the chenille yarn and the non-chenille yarn.

14. A single jersey weft knitted fabric comprising at least two yarns, a chenille yarn and a ground yarn, the chenille yarn having a decitex in the range 2000 to 5000 and the ground yarn having a decitex in the range 550 to 900, there being in the range 8 to 16 wales per inch in a course-wise direction of the fabric, and in the range 8 to 30 courses per inch in a wale-wise direction, the chenille yarn being present in the fabric with the ground yarn as full loop stitches, each stitch comprising only one of the ground yarn and the chenille yarn and with the chenille yarn evident on the technical reverse side of the fabric.

15. A weft knitted double jersey upholstery fabric comprising at least two yarns, one of which is a chenille yarn and the other or each other yarn is a non-chenille yarn, said chenille yarn and non-chenille yarn being present in the fabric as full loop stitches, each stitch comprising only one of the chenille yarn and the non-chenille yarn, and the chenille yarn appearing on one side only of the fabric in any predetermined region of the fabric, the yarn count of the chenille yarn being greater than that of the non-chenille yarn and there being a greater number of stitches of non-chenille yarn on the non-chenille side of the fabric whereby the fabric is balanced and substantially non-curling.

* * * * *